US006024076A

United States Patent [19]

Laborde et al.

[11] Patent Number: 6,024,076

[45] Date of Patent: Feb. 15, 2000

[54] ARCHERY BOW HAVING PIVOTAL BOW LIMB POCKETS

[75] Inventors: Brian Laborde; Gary L. Simonds, both of Gainesville, Fla.

[73] Assignee: Bear Archery, Inc., Gainesville, Fla.

[21] Appl. No.: 08/865,986

[22] Filed: May 30, 1997

[51] Int. Cl.[7] ..... F41B 5/00

[52] U.S. Cl. ..... 124/23.1

[58] Field of Search ..... 124/23.1, 25.6, 124/86, 88

[56] References Cited

U.S. PATENT DOCUMENTS

| | | | |
|---|---|---|---|
| 3,486,495 | 12/1969 | Allen | 124/25.6 |
| 3,957,027 | 5/1976 | Drake | 124/23.1 |
| 3,958,551 | 5/1976 | Ketchum | 124/25.6 |
| 4,064,862 | 12/1977 | Groner | 124/25.6 |
| 4,261,320 | 4/1981 | Barna | 124/25.6 |
| 4,644,929 | 2/1987 | Peck | 124/23.1 |
| 5,280,799 | 1/1994 | Smith | 124/88 |
| 5,429,106 | 7/1995 | Martin et al. | 124/23.1 |
| 5,464,001 | 11/1995 | Peck | 124/25.6 |
| 5,487,373 | 1/1996 | Smith | 124/23.1 |
| 5,507,270 | 4/1996 | Smith | 124/23.1 |
| 5,515,836 | 5/1996 | Martin et al. | 124/23.1 |
| 5,592,929 | 1/1997 | Hoyt | 124/23.1 |
| 5,660,158 | 8/1997 | Rudolph | 124/23.1 |
| 5,720,267 | 2/1998 | Walk | 124/23.1 |
| 5,722,380 | 3/1998 | Land et al. | 124/25.6 |

*Primary Examiner*—John A. Ricci
*Attorney, Agent, or Firm*—Malina & Wolson

[57] ABSTRACT

An archery bow includes pivoting limb pockets for attaching two split limbs or a single limb to the bow handle. The limb pockets are secured to the handle by an adjustment bolt. Circular mating portions on the pocket and handle permit rotation of the pocket about the handle. A slug which is press-fitted in the handle provides lateral stability between the pocket and handle. The front wall of the pocket prevents limb movement in the axial direction and the top surface of the pocket limits upward movement.

21 Claims, 6 Drawing Sheets

ARCHERY BOW HAVING PIVOTAL BOW LIMB POCKETS

A. BACKGROUND OF THE INVENTION

1. Field of the Invention

This invention relates to archery bows and, in particular, to a pivotal pocket for mounting a bow limb on a handle.

2. Description of the Prior Art

There are a number of different archery bow configurations, the more traditional forms of which include the English long bow, the Turkish Recurve and the American Indian Flat bow. Other more modern bows include the one-piece and take-apart recurve bow. The most recent such bow is the highly popular compound bow. In all of these bow designs, the archer pulls the bow string which, in turn, flexes the bow limbs to temporarily store energy. When the archer releases the bow string, the bow limbs return to their original position, thus taking up the bow string and transferring the energy from the bow limbs through the bow string to the arrow.

Unlike the traditional bows of the past that were made in one piece, most modern bows are made up of separate handle and limb units that are mechanically assembled to form the bow. While the present invention refers to the attachment of flexible limbs to the handles of compound bows, it may also be used with the modern take-apart or take-down recurve bows.

Compound bows differ from traditional bows in that they utilize a variable leverage system at the limb tips to provide a system that is capable of storing more energy for a given draw length. The mechanical advantage provided by the variable leverage system also allows the archer to hold the bow at full draw with much less effort so that aiming the bow is accomplished with less strain. While the compound bow variable leverage system reduces the strain placed on the archer, it increases the mechanical operating stress and strain on individual bow components. For that reason, compound bows require considerably stiffer limbs for a given bow draw weight than do traditional bows. The stiffer limbs apply greater loads and bending moments to the bow handle and therefore the connection between the limb and handle must be strong and positive. It is further desirable that the resistance provided by the limbs be adjustable over a predetermined range of bow draw weights.

The prior art, such as U.S. Pat. No. 4,261,320, provides for adjustably attaching the bow limbs by means of a pivot at each end of the handle of a compound bow. The pivot consists of a semicircular groove in each end of the handle which is perpendicular to the length of the handle. Each limb is fitted with a half round member having a flat side and a curved side. The flat side of the half round member fits against the limb near the fixed end, and the curved side is mated to a semicircular groove in the handle end. The side walls of the handle also form the side walls of the limb pocket. The patent further discloses a second method of pivotally attaching bow limbs to a handle in which the male pivot portion is part of or affixed to each end of the bow handle. The other end of a limb pivot plate is fitted with a threaded means to adjustably attach it to the bow handle. Both methods require that the bow handle be of a hollowed out configuration in the area of limb attachment and thus have limited, if any, applicability to the relatively narrow solid metal bow handles presently in use.

More recent prior art relating to the pivotal attachment of the bow's limbs to the handle include U.S. Pat. No. 3,486, 495; U.S. Pat. No. 3,957,027; U.S. Pat. No. 3,958,551; U.S. Pat. No. 4,064,862 and U.S. Pat. No. 5,280,779.

B. SUMMARY OF THE INVENTION

The invention accomplishes the foregoing objectives by providing a pivotal pocket within which the ends of a bow limb set (or the end of a bow limb) are mounted and which is attached to a bow handle through a matching pivot arrangement between the handle and the pivotal pocket. The pocket has a recess that receives and closely fits around at least three sides of each limb member. The pocket and the end of the limb are arranged such that there is an opening having sufficient clearance for the limb and an adjustable bolt to pass. The head of the adjustable bolt engages a fitted washer which, in turn, is in contact with the upper surface of the pocket. The other end of the adjustable bolt threads into the bow handle securing the end of the pocket to the handle.

The upper surface of the pocket evenly distributes the force necessary to retain the bow limbs in position through the upper surface of a resilient internal limb boot. The limbs are held in alignment by a semi-rigid rocker which serves as a fulcrum and locates the limbs accurately about the centerline of the limb pocket. A separate saddle strip fitted about the rocker has raised tabs which project upwardly between the outer edges of the limbs and the vertical side walls of the pocket to maintain the spatial relationship of the limbs. The pocket is made of a suitable high-strength material so as to be able to withstand the loads necessary to retain and keep the individual bow limbs properly aligned.

Accordingly, it is an objective of this invention to provide an improved means for securing the limbs to the handle of an archery bow.

A further object of this invention is to provide an improved archery bow in which the limbs are secured to the handle through the use of pivoting pocket members.

Another object of this invention is to provide pocket members for receiving and securing the ends of the limbs of a bow to the bow handle.

A further object of this invention is to provide an improved archery bow in which the components for attaching the limbs to the handle can be of a different material than that of the handle.

A still future object of this invention is to reduce the cost and simplify the manufacture and assembly of bows made up of separate handle and limb components.

An additional object of this invention is to provide adjusting means in the pivotal pocket for varying the bow limb resistance to provide a predetermined range of bow draw weights.

Other objects and attendant advantages of this invention will be readily appreciated as the same becomes more clearly understood by references to the following detailed description when considered in connection with the accompanying drawings in which like reference numerals designate like parts throughout the figures thereof.

DETAILED DESCRIPTION OF THE DRAWINGS

Figure 1:
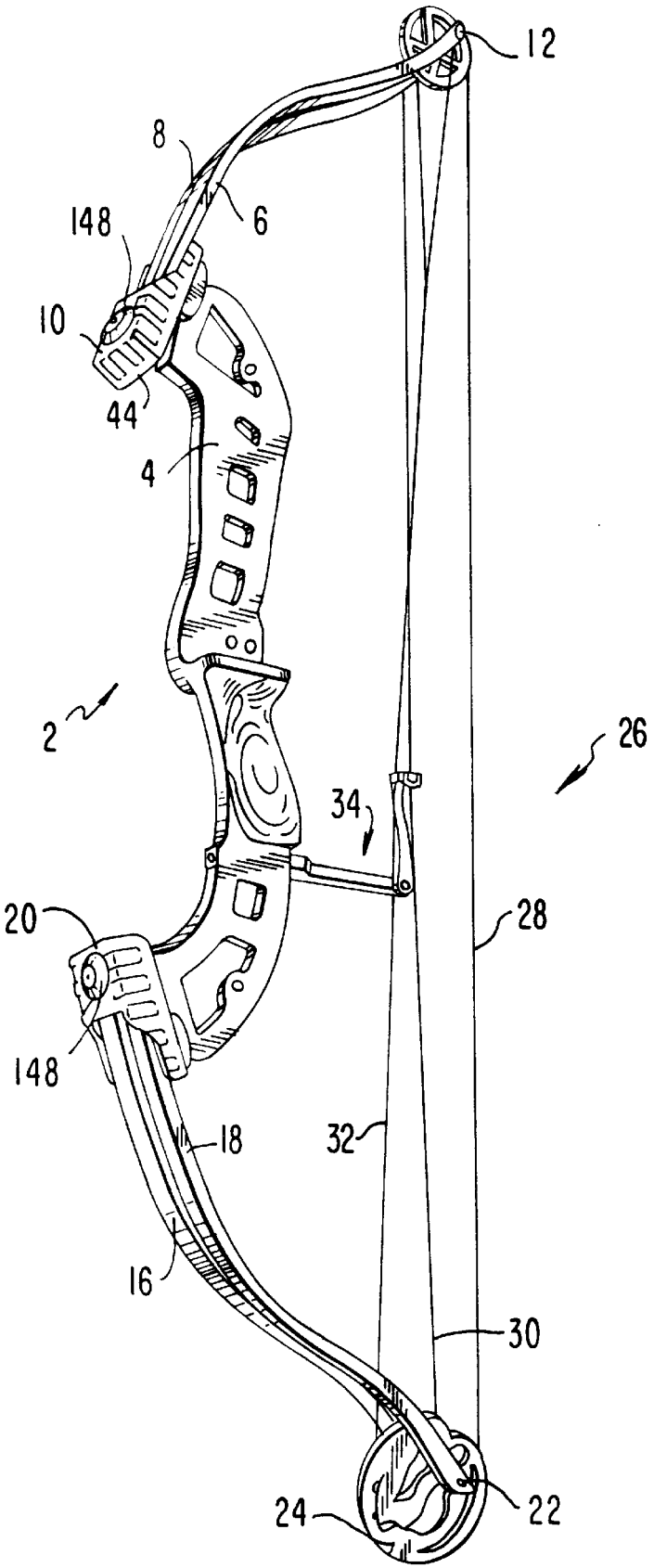
FIG. 1 is a perspective view of a compound bow having pivotal limb pockets constructed in accordance with the present invention.
Figure 2:
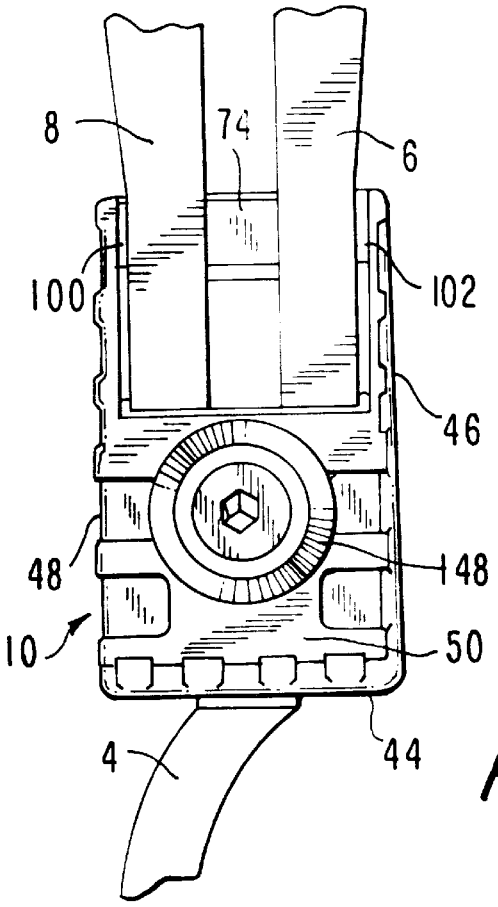
FIG. 2 is a top view of a pivotal limb pocket constructed in accordance with the present invention.
Figure 12:
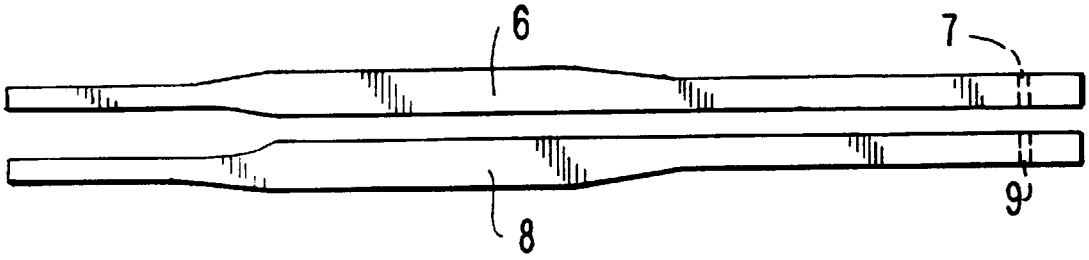
FIG. 12 is a top view of a split bow limb which may be mounted within the pivotal pocket of the present invention.

As shown in FIG. 1, the archery bow 2 includes a handle 4 and upper split limbs 6 and 8 which are connected at a first end to handle 4 by means of a pivotal pocket 10. Pivotal pocket 10 may be made of suitable high strength material such as aluminum castings. An axle pin 12 is supported in openings 7 and 9 at the second end of upper split limbs 6 and 8 (see FIG. 12), and a concentric pulley 14 is mounted on axle pin 12. Similarly, lower split limbs 16 and 18 are connected at a first end to handle 4 by means of a pivotal pocket 20. An axle pin 22 extends through openings at the other end of lower split limbs 16 and 18, and a dual feed-out cam 24 is mounted on axle pin 22. A cable 26 has a medial portion trained around concentric pulley 14 to form a bow string 28 and a return section 30, both of which extend across the archery bow 2 and are connected to dual feed-out cam 24. An anchor cable 32 is anchored at one end to the axle pin 12 and extends across the bow and is connected to the take-up side of dual feed-out cam 24. A conventional cable guard 34 is mounted on handle 4 to deflect the cables from the path of the arrow. The archery bow thus far described, with the exception of pivotal pockets 10 and 20, is of the type described in U.S. Pat. No. 5,368,006, "Dual-Feed Single-Cam Compound Bow". It should be noted, however, that the present invention is also useful in more traditional compound archery bows having two feed-out cams.

Pivotal pockets 10 and 20 are identical in structure and function, and thus, for simplicity purposes, only pivotal pocket 10, and its relation with handle 4 and upper split limbs 6 and 8, will be further described. The description is, of course, equally applicable with respect to pivotal pocket 20, and its relation to handle 4 and lower split limbs 16 and 18.

Figure 6:
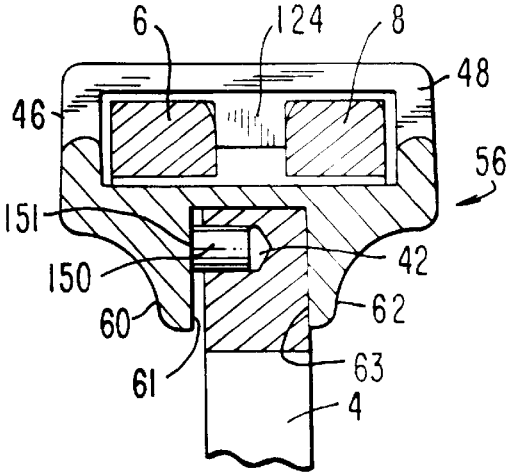
FIG. 6 is a side elevational view of the pivotal limb pocket of the present invention taken along the plane B—B of FIG. 4, and wherein the archery bow includes split limbs.

Handle 4 is a conventional archery bow, having a handgrip portion 36, and wherein the ends of the handle have been modified to accommodate pivotal pocket 10 in a manner to be described in greater detail below. At this juncture, it is noted only that handle 4 differs from a conventional handle by including a raised circular section 38 on the edge surface 40 of handle 4 (see FIG. 4). Raised circular sector 38 includes a circular opening 42 which extends into the raised circular sector 38 and terminates in a triangular portion (see FIG. 6).

Figure 8:
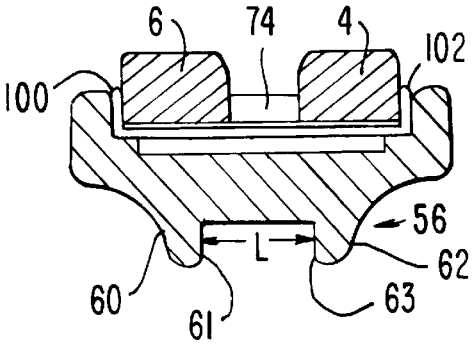
FIG. 8 is a side elevational view of the pivotal limb pocket of the present invention taken along the plane A—A of FIG. 4, and wherein the archery bow includes split limbs.

Pivotal pocket 10 includes a front wall 44 and side walls 46 and 48. A cover portion 50 having an opening 52 therein is integral with walls 44, 46 and 48. Pivotal pocket 10 includes an opening 54 opposite cover portion 50 and a shaped section 56 extending from side walls 46 and 48 at the rear of pivotal pocket 10. Shaped section 56 of pivotal pocket 10 includes a wall 58, the height of which is substantially lower than the height of opposite wall 44, to provide an opening in pivotal pocket 10 for receiving upper split limbs 6 and 8. Shaped section 56 further includes downwardly and inwardly extending integral extensions 60 and 62 having a space therebetween of width L (see FIG. 8). Extension 60 includes an inner surface 61 and extension 62 includes an inner surface 63.

A first circular sector 64 in shaped section 56 is configured to provide a complementary mating surface with circular sector 38 of handle 4, whereby first circular sector 64 of shaped section 56, and thus pivotal pocket 10, is pivotal about raised circular sector 38 of handle 4. Shaped section 56 terminates in an upward extension 66 which is spaced from the underside of upper split limbs 6 and 8.

Figure 9A:
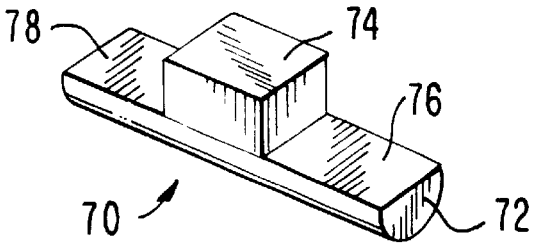
FIG. 9A is a perspective view of a first embodiment of a rocker utilized in the present invention to support the split bow limbs of an archery bow.
Figure 9B:
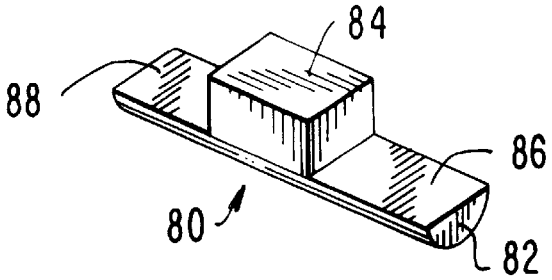
FIG. 9B is a perspective view of a second embodiment of a rocker utilized in the present invention to support the split bow limbs of an archery bow.

Shaped section 56 includes a second circular sector 68 within which rockers of various heights are rotatable therein. The rocker 70, shown in FIG. 9A, comprises an arcuate section 72 having a limb separator 74 integral therewith which divides arcuate section 72 into two equal surfaces, 76 and 78. The rocker 80, shown in FIG. 9B, likewise comprises an arcuate section 82 having a limb separator 84 integral therewith which divides arcuate section 82 into two equal surfaces, 86 and 88. The difference between rocker 70 and rocker 80 is that the height of arcuate section 72 of rocker 70 exceeds the height of arcuate section 82 of rocker 80 and, as a result, rocker 70 will prestress limbs 6 and 8 a greater amount than rocker 80.

Figure 11A:
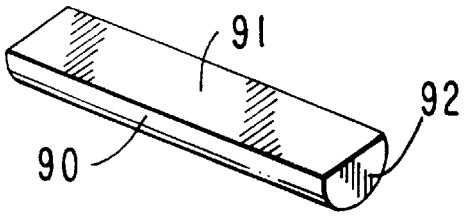
FIG. 11A is a perspective view of a first embodiment of a rocker utilized in the present invention to support a single bow limb.
Figure 11B:
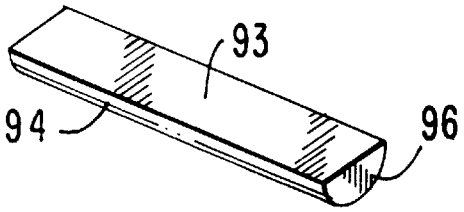
FIG. 11B is a perspective view of a second embodiment of a rocker utilized in the present invention to support a single bow limb.

Alternative forms of rockers adopted for use with bows having single limbs are shown in FIGS. 11A and 11B. The rocker 90, shown in FIG. 11A, is formed of a flat surface 91 and an arcuate section 92 and the rocker 94, shown in FIG. 11B, is formed of a flat surface 93 and an arcuate section 96. The difference between rocker 90 and rocker 94 is that the height of arcuate section 92 of rocker 90 is greater than the height of arcuate section 96 of rocker 94.

Figure 10:
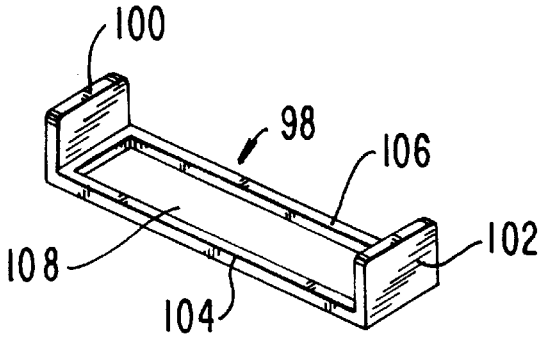
FIG. 10 is a perspective of a saddle strip in which the rockers are located.

A saddle strip 98, see FIG. 10, comprises tabs 100 and 102 and connecting strips 104 and 106. The opening 108 within saddle strip 98 is of a size to accommodate the arcuate section 72 of rocker 70, the arcuate section 82 of rocker 80, the arcuate section 92 of rocker 90, or the arcuate section 96 of rocker 94.

Figure 5A:
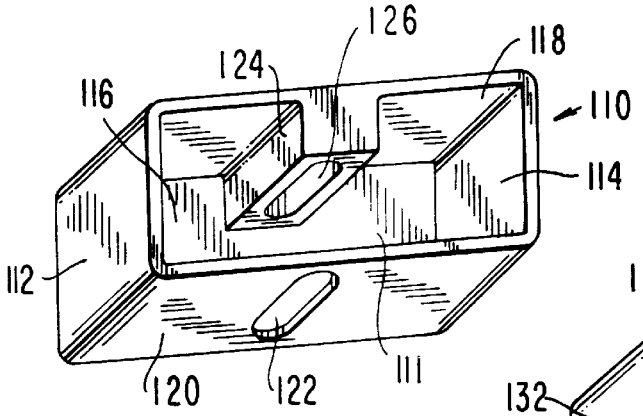
FIG. 5A is a perspective view of an internal boot limb of the present invention, which is utilized to hold an archery bow which includes split limbs.

An internal limb boot 110, shown in FIG. 5A, includes an opening 111 formed by side walls 112 and 114, front wall 116, top surface 118 and bottom surface 120. An opening 122 is located in bottom surface 120. A limb separator 124, for separating upper split limbs 6 and 8 is integral with top surface 118 of internal limb boot 110. Limb separator 124 includes an opening 126 of the same configuration as opening 122 in bottom surface 120.

Figure 5B:
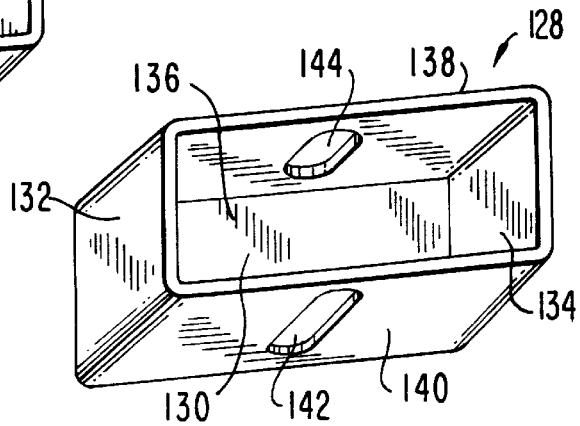
FIG. 5B is a perspective view of an internal boot limb of the present invention, which is utilized to hold an archery bow which includes a single limb.

An alternative limb boot 128 for retaining a single limb at each end of the bow is shown in FIG. 5B. Limb boot 128 includes an opening 130 formed by side walls 132 and 134, front wall 136, top surface 138 and bottom surface 140. An opening 142 is located in bottom surface 140, and an identical opening 144 is located in top surface 138.

Figure 3:
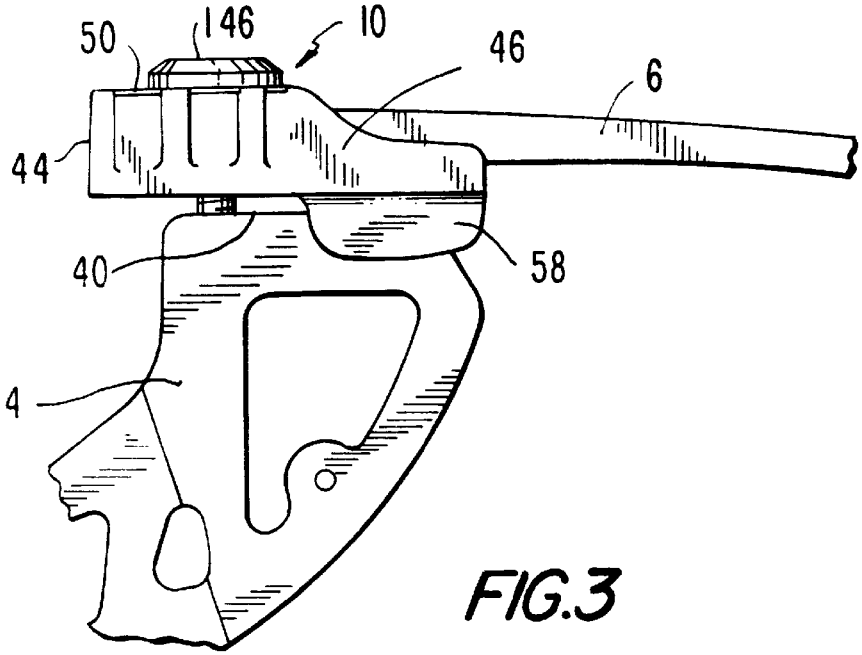
FIG. 3 is a side elevation view of the pivotal limb pocket shown in FIG. 2.
Figure 4:
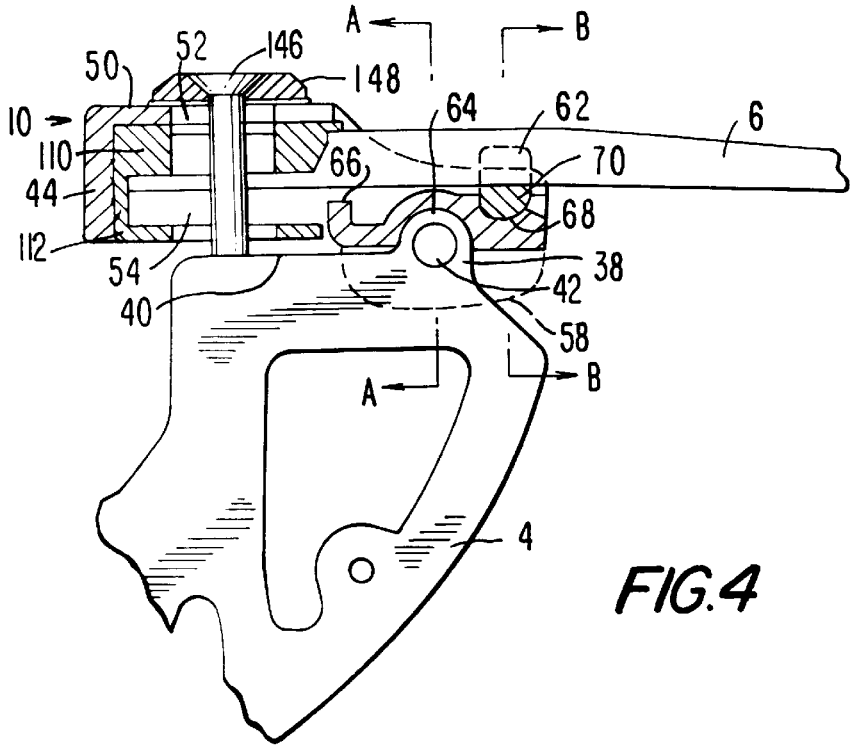
FIG. 4 is a sectional view of the pivotal limb pocket shown in FIG. 3.

An adjustment bolt 146, see FIG. 4, seated on a load distributing washer 148, has threads 147 (see FIG. 3) on the end thereof. Adjustment bolt 146 extends through opening 52 of cover portion 50 of pocket 10, through openings 126 and 122 of the internal limb boot 110, when the archery bow includes split limbs, and is threadably engaged in a threaded portion (not shown) in the top of handle 4. Adjustment bolt 146 extends through opening 52 of cover portion 50 of pocket 10, and through openings 142 and 144 of the internal limb boot 128, shown in FIG. 5B, when the archery bow includes single limbs.

Three embodiments are disclosed for providing a precision fit between the extensions 60 and 62 of pivotal pocket 10 and handle 4. In the FIG. 6 embodiment, a slug 150, press-fitted into circular opening 42 in handle 4, has an end 151 in contact with the inner surface 61 of extension 60, in such a manner that the distance between the end of slug 150 that contacts inner surface 61 and inner surface 63, is the same as the distance between inner surface 61 and inner surface 63. Slug 150 may be formed of material such as brass.

Figure 6A:
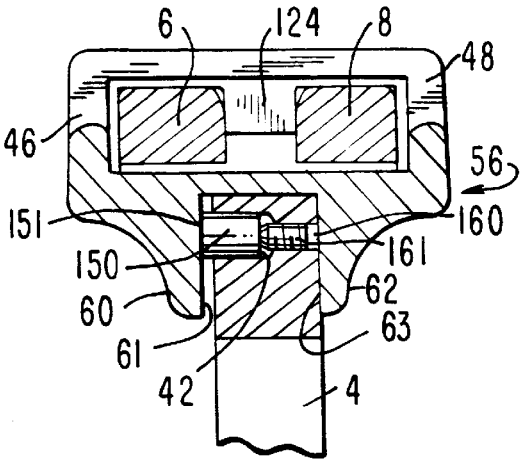
FIG. 6A is a side elevational view of a second embodiment of the pivotal limb pocket of the present invention and wherein the archery bow includes split limbs.

In the FIG. 6A embodiment, a slug 150, press-fitted into circular opening 42 in handle 4, has an end 151 in contact with the inner surface 61 of extension 60, in such a manner that the distance between the end of slug 150 that contacts inner surface 61 and inner surface 63, is the same as the distance between inner surface 61 and inner surface 63. Threaded opening 160 in bow handle 4 is located axially in line with opening 42 and contains set screw 161 which is tightened down against the inner surface of slug 150 to maintain the distance from the slug's outer surface 151 and the inner surface 63 in the manner described above.

Figure 7:
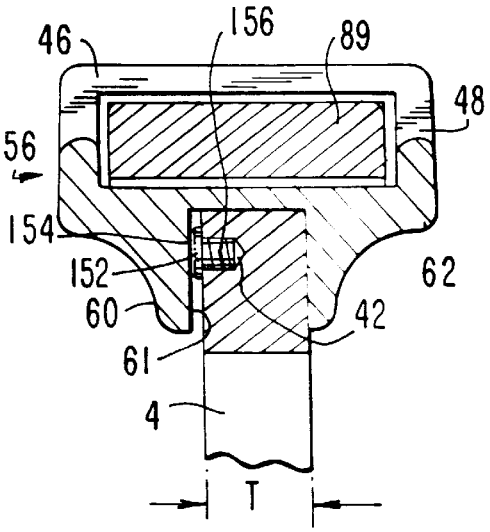
FIG. 7 is a side elevational view of the pivotal limb pocket of the present invention taken along the plane B—B of FIG. 4, and wherein the archery bow includes a single limb.

In the FIG. 7 embodiment, the slug 152, which may be formed of a semi-resilient load-bearing material such as Delrin or Nylon has a head portion 154 of a thickness nearly equal to the difference between the distance L between the inner surfaces 61 and 63 and the thickness T of handle 4. As in the FIG. 6 embodiment, the body portion 156 of slug 152 is press-fitted into circular opening 42 in handle 4. The top of the head portion 154 is in contact with the inner surface 61 of extension 60.

The pivotal pocket 10 may be assembled in the following manner to accommodate split limbs 4 and 6. The internal limb boot 110 is inserted into the opening 54 of pivotal pocket 10. Then slug 150 (or slug 152) is press-fitted into circular opening 42 of handle 4. Pivotal pocket 10 is placed over handle 4 in such a manner that the inner surface 61 of extension 60 abuts against the end 151 of slug 150, and the first circular section 64 of pivotal pocket 10 is pivotal about raised circular sector 38 of handle 4. In this manner, slug 150 provides stability between pivotal pocket 10 and handle 4 while still permitting pivotal pocket 10 to rotate about handle 4.

The saddle strip 98 is placed around the second circular section 68 and either rocker 70 or 80 is selected to be placed in the opening 108 of saddle strip 98. If it is desirable to increase the prestress of the limbs 6 and 8, the rocker 70, whose arcuate section 72 is of greater height than the arcuate section 82 of rocker 80, is utilized. Assuming that rocker 70 has been selected, then the limbs 6 and 8 are placed on surfaces 76 and 78 of rocker 70 within tabs 100 and 102 of saddle strip 98. Tabs 100 and 102 assure proper alignment of limbs 6 and 8. The ends of limbs 6 and 8 are inserted completely into internal limb boot 110 so that the bottom surface of limbs 4 and 6 rest on rocker 70 and limbs 4 and 6 are separated by limb separator 124.

From the foregoing, it will be noted that the end of each limb 6 and 8 rests against the inside of front wall 116 of internal limb boot 110, the top surface of limbs 6 and 8 rest securely against the underside of top surface 118 of internal limb boot 110, and the outer edges of limbs 6 and 8 are adjacent the inside of side walls 112 and 114 of internal limb boot 110. The adjustment bolt 146 is inserted through load distributing washer 148, through opening 52 of pivotal pocket 10, through openings 126 and 122 of internal limb boot 110, and then adjustably threaded the desirable amount into a threaded opening in the edge surface 40 of handle 4.

To accommodate the single limb 89, the pivotal pocket 10 may be assembled in the following manner. The internal limb boot 128 is raised into the opening 54 of pivotal pocket 10. Then slug 150 (or slug 152) is press-fitted into circular opening 42 of handle 4. Pivotal pocket 10 is placed over handle 4 in such a manner that the inner surface 61 of extension 60 abuts against the end 151 of slug 150, and the first circular section 64 of pivotal pocket 10 is pivotal about raised circular sector 38 of handle 4.

The saddle strip 98 is placed around the second circular section 68 and either rocker 90 or 94 is selected to be placed in the opening 108 of saddle strip 98. If it is desirable to increase the prestress of the limb 89, the rocker 90, whose arcuate section 92 is of greater height than the arcuate section 96 of rocker 94, is utilized. Assuming the rocker 90 has been selected, then the limb 89 is placed on the flat surface 91 of rocker 90, within tabs 100 and 102 of saddle strip 98. Limb 89 is then inserted into limb boot 128 with the bottom surface of limb 89 resting on rocker 90. In this manner, the end of limb 89 rests against the inside of front wall 136, the top surfaces of limb 89 rests securely against the underside of top surface 138 of limb boot 128, and the outer edges of limb 89 fit is adjacent the inside of side walls 132 and 134 of limb boot 128.

The adjustment bolt 146 is inserted through load distributing washer 148, through an opening in the limb (not shown), through opening 52 of pivotal pocket 10, through openings 144 and 142 of limb boot 128, and then adjustably threaded the desirable amount into a threaded opening in the edge surface 40 of handle 4.

From the foregoing, it will be understood that the force necessary to retain the bow limbs 6 and 8 in position is evenly transmitted by the upper surface 50 of pivotal pocket 10, through the limb boot 110 or 128. It will be further understood that limbs 6 and 8 are held in alignment and accurately positioned by rocker 70 or 80 and limb separators 74 or 84 thereon. Likewise, limb 89 is held in alignment by rocker 90 or 94. Rockers 70, 80, 90, and 94 may be formed of semi-rigid material, such as glass filled nylon. Tabs 100 and 102 of saddle strip 98 maintain the spatial relationship of the limbs to the pivotal pocket. It should be further noted that since the limb pockets are separate items and not attached to the handle, they do not affect the thickness of the handle, as would be the situation if the pockets were integral with the handle.

What is claimed as novel and desired to be secured by Letters Patent is:

1. An archery bow including a handle, at least one limb connected to said handle, a bow string, and a pivotal pocket mounted on said handle, said pivotal pocket having an end with said at least one limb located therein, means preventing lateral movement of said end of said limb with respect to said pivotal pocket and an internal limb boot located within the pivotal pocket for preventing pivotal movement of said end of said limb with respect to said pivotal pocket, said pivotal pocket and said handle having complementary mating surfaces to permit the pivotal pocket with at least said one limb therein to pivot about said handle.

2. An archery bow as recited in claim 1, wherein said complementary mating surfaces comprise circular sectors.

3. An archery bow as recited in claim 2, wherein the mating surface of the pocket is a female circular sector and the mating surface of the handle is a male circular sector.

4. An archery bow as recited in claim 1, wherein said pivotal pocket and handle are connected by an adjustable bolt.

5. An archery bow as recited in claim 1, wherein the means for preventing lateral movement of said end of said limb with respect to said pivotal pocket is the internal limb boot located within the pivotal pocket.

6. An archery bow as recited in claim 5, wherein the end of said at least one limb rests against the inside of a front wall of said limb boot.

7. An archery bow as recited in claim 5, wherein a top surface of the end of said at least one limb rests against the underside of a top surface of said limb boot.

8. An archery bow as recited in claim 5, wherein the outer edges of the end of said at least one limb are adjacent the inside of at least one of the side walls of said limb boot.

9. An archery bow as recited in claim 5, wherein said pivotal pocket and said limb boot have openings therein for receiving an adjustable bolt.

10. An archery bow as recited in claim 1, wherein a bottom surface of the end of said at least one limb rests on a support rotatably positioned in said pivotal pocket.

11. An archery bow as recited in claim 10, wherein the height of said support may be varied.

12. An archery bow as recited in claim 10, wherein the support is located within an opening in a saddle strip, and wherein tabs on the saddle strips provide a snug fit between the outer edges of said at least one limb and side walls of said pivotal pocket.

13. An archery bow as recited in claim 1, wherein said pivotal pocket includes side walls having extensions therefrom, and wherein said extensions straddle said bow handle.

14. An archery bow as recited in claim 13, and further including an opening in the handle having a slug therein, and wherein an end of the slug opposite the handle is in contact with an inside surface of said side wall extension.

15. An archery bow as recited in claim 14 and further including a set screw located in a threaded opening in the handle, and wherein said set screw is moveable against said slug to force said slug into contact with an inside surface of said side wall extension.

16. An archery bow as recited in claim 14, and wherein said slug includes a flanged head which is in contact with said inside surface of said side wall extension.

17. An archery bow as recited in claim 1, having ends of two limbs connected to the same surface of said handle.

18. An archery bow as recited in claim 17, wherein the pivotal pocket includes an internal limb boot therein and said limb boot comprises a limb separator for separating the two limbs.

19. An archery bow as recited in claim 17, wherein the bottom surfaces of said two limbs rest on a rocker rotatably positioned in said pivotal pocket, and wherein said rocker includes a limb separator thereon for separating the two limbs.

20. An archery bow as recited in claim 1, wherein a bottom surface of said at least one limb rests on a fulcrum pad positioned in said pivotal pocket.

21. An archery bow as recited in claim 20, wherein the height of said fulcrum pad may be varied.

* * * * *